US006171412B1

(12) United States Patent
Matsuoka et al.

(10) Patent No.: US 6,171,412 B1
(45) Date of Patent: Jan. 9, 2001

(54) COATED SEIZURE-HARDENING TYPE COLD-ROLLED STEEL SHEET HAVING EXCELLENT AGING RESISTANCE AND METHOD OF PRODUCTION THEREOF

(75) Inventors: Saiji Matsuoka; Masahiko Morita, both of Okayama; Osamu Furukimi; Takashi Obara, both of Chiba; Tetsuya Kiyasu; Yoshio Yamazaki, both of Okayama, all of (JP)

(73) Assignee: Kawasaki Steel Corporation (JP)

( * ) Notice: Under 35 U.S.C. 154(b), the term of this patent shall be extended for 0 days.

(21) Appl. No.: 09/194,533

(22) PCT Filed: Apr. 8, 1998

(86) PCT No.: PCT/JP98/01623

§ 371 Date: Nov. 25, 1998

§ 102(e) Date: Nov. 25, 1998

(87) PCT Pub. No.: WO98/45494

PCT Pub. Date: Oct. 15, 1998

(30) Foreign Application Priority Data

Apr. 9, 1997 (JP) ..... 9-090731
Apr. 15, 1997 (JP) ..... 9-096830
Aug. 22, 1997 (JP) ..... 9-226073

(51) Int. Cl.[7] ..... C21D 8/00; C21D 8/02
(52) U.S. Cl. ..... 148/320; 148/330; 148/603
(58) Field of Search ..... 148/603, 320, 148/330

(56) References Cited

U.S. PATENT DOCUMENTS 4,504,326 * 3/1985 Tokunaga et al. ..... 148/603
4,576,657 * 3/1986 Satoh et al. ..... 148/603
5,846,343 * 12/1998 Yasuhara et al. ..... 148/603

* cited by examiner

*Primary Examiner*—Deborah Yee
(74) *Attorney, Agent, or Firm*—Austin R. Miller

(57) ABSTRACT

Disclosed are bake-hardenable sheet steel with good anti-aging property and a method for producing it. While controlling its C, P, S and N contents, the chemical composition of the sheet steel is defined to comprise not larger than 1.0% of Si, not larger than 3.0% of Mn, from 0.01 to 0.20% of Al and from 0.001 to 0.2% of Ti, in terms of % by weight. The value A ($=(AI_{QUENCH}-AI)/AI_{QUENCH}$) of the sheet steel is defined to be not smaller than 0.4 and the value $AI_{QUENCH}$ thereof to be not smaller than 30; or the ratio of the mean misorientation, M (degree), to the mean grain size, G ($\mu$m), M/G, of the sheet steel is defined to be not smaller than 0.8. The steel may additionally contain from 0.001 to 0.2% of Nb and/or from 0.0001 to 0.0080% of B. While controlling its Si, Mn, S, Al and N contents, the chemical composition of a steel slab is defined to comprise from 0.005 to 0.02% of C, not larger than 0.05% of P and from 0.025 to 0.19% of Nb, with satisfying the condition of $0.7\times(C/12)\leqq Nb/93\leqq 1.2\times(C/12)$ (where C indicates the C content (wt. %), and Nb indicates the Nb content (wt. %)). To produce bake-hardenable sheet steel from it, the slab is heated, hot-rolled at a finishing delivery temperature of from 960 to 650° C., coiled at a temperature of from 750 to 400° C., then cold-rolled to a reduction of from 50 to 95%, and thereafter annealed for recrystallization at a temperature of from 750 to 920° C. The slab may additionally contain B and/or Ti. The invention stably produces bake-hardenable sheet steel on an industrial scale.

12 Claims, 2 Drawing Sheets

COATED SEIZURE-HARDENING TYPE COLD-ROLLED STEEL SHEET HAVING EXCELLENT AGING RESISTANCE AND METHOD OF PRODUCTION THEREOF

FIELD OF THE INVENTION

The present invention relates to cold-rolled, thin sheet steel, in particular, to that for car bodies. The sheet steel is, after having been worked for bending, press-forming and drawing, painted and baked, and has many applications in the art.

BACKGROUND OF THE INVENTION

For lightweight cars, thin sheet steel with high tensile strength is desired and investigated. However, sheet steel with increased tensile strength often has poor press formability. Therefore, it is desired to develop sheet steel with both good press formability and high tensile strength.

As one type of sheet steel with both good press formability and high tensile strength applicable to the production of car bodies, known is bake-hardenable sheet steel. This is, after having been worked by pressing, painted and baked generally at high temperatures falling between 100 and 200° C., whereby its yield strength is increased due to the action of the solute carbon (C) existing therein. Precisely, the solute C in the sheet steel having been heated for baking is fixed to the dislocation site as introduced into the steel while the steel is worked by pressing, to prevent the dislocation site from being moved in the steel, thereby increasing the yield strength of the steel. It is said that the bake-hardenable sheet steel for cars of that type must have a degree of bake hardenability (BH) of not smaller than 30 MPa.

However, in the bake-hardenable sheet steel, the dislocation site is often partly fixed by the solute C before the steel is worked by pressing, causing ridged surface defects of so-called stretcher strains when the steel is worked by pressing. The stretcher strains result from the increase in the yield point elongation of the steel being press-worked, and greatly lowers the product quality of the steel. Thus, the known, bake-hardenable sheet steel is problematic in that its anti-aging property is poor.

To solve the problem of such poor anti-aging property, proposed is another type of bake-hardenable sheet steel with improved anti-aging property. For example, Japanese Examined Patent Publication (JP-B) No. Sho-61-12008 discloses a method for producing dual-phase structured, high-strength sheet steel for deep drawing, which comprises a step of hot-rolling extra low-C steel containing both Nb of from 2 to 10 times the C content of the steel and B of not smaller than 0.3 times the N content thereof, at a low coiling temperature ranging between 550 and 200° C., as combined with a step of annealing it within the $\alpha$–$\gamma$ dual-phase range of the steel followed by rapidly cooling it, to thereby make the resulting sheet steel have an elevated r value and good bake-hardenability. The disclosed method is characterized by the heating within the $\alpha$–$\gamma$ dual-phase range of the steel followed by the rapid cooling to give the dual-phase structure composed of acicular ferrite and ferrite. The structure contains solute C and has a high degree of bake-hardenability (BH), in which, however, most solute C is trapped by the acicular ferrite having a high dislocation density. Therefore, the yield point elongation of the sheet steel is increased little after annealing.

In addition, the method disclosed in JP-B Sho-61-12008 is problematic in that it requires high-temperature annealing within the $\alpha$–$\gamma$ dual-phase range of extra low-C steel and that the $\alpha$–$\gamma$ dual-phase range of the steel is too narrow to stably ensure the intended quality of the steel throughout the process of the method.

As being essentially used for outer panels of car bodies, bake-hardenable sheet steel discussed herein requires good ductility for uniform elongation relative to its press formability, in particular, to its stretch formability. The ductility for uniform elongation is indicated by the maximum tensile strength of sheet steel tested in a tensile test. It is said that sheet steel having a lower yield strength or having a higher work-hardenability index, n, shall have better ductility for uniform elongation. For bake-hardenable sheet steel, however, that having a higher yield strength after baked is more preferred. Therefore, it has heretofore been difficult to obtain favorable bake-hardenable sheet steel having good ductility for uniform elongation.

The present invention is to solve the problems noted above, and its object is to provide bake-hardenable sheet steel and galvanized sheet steel having good anti-aging property and capable of being stably produced on an industrial scale. The object is also to provide such sheet steel having good ductility for uniform elongation and having improved press formability.

Given the situation, we, the present inventors have assiduously studied in order to obtain extra low-C sheet steel having a high degree of BH and good anti-aging property, and, as a result, have found that, in sheet steel, solute C expressing BH-ability differs from solute C participating in room-temperature aging with respect to the sites where they exist. Specifically, in the bake-hardening treatment for heating sheet steel at a high temperature of 170° C. or so, all solute C existing inside and around the grains of steel, or that is, all intragranular and intergranular solute C in steel participates in the BH-ability of the steel. On the other hand, however, since the temperature for room-temperature aging treatment is lower than that for bake-hardening treatment, the intergranular solute C existing in the grain boundaries of steel could not diffuse into the grains but are still kept stabilized in the grain boundaries during room-temperature aging treatment. As a result, only the intragranular solute C existing inside the grains of steel participates in room-temperature aging of steel, while the intergranular solute C existing around the grains has no influence on the room-temperature treatment. Thus, the intergranular solute C participates in the BH-ability of steel but not in the anti-aging property thereof. As opposed to this, the intragranular solute C participates in both the BH-ability and the anti-aging property of steel.

In addition, the present inventors have further found that sheet steel in which the ratio of the misorientation to the grain size is defined to be not smaller than a specific value may have good anti-aging property even though it has high BH-ability. Specifically, by reducing the grain size while increasing the intergranular area to thereby enlarge the degree of misorientation in sheet steel, the amount of C existing in grain boundaries in the sheet steel can be increased whereby both the BH-ability and the anti-aging property of the sheet steel can be improved. In this connection, still another finding of the inventors is that the reduction in the amount of P that interferes with the intergranular segregation of C in sheet steel is important.

Moreover, the inventors have found that the amount of solute C existing inside and around the grains in sheet steel can be well controlled by optimizing the relationship between the slab reheating temperature and the S content of the steel, whereby the BH-ability and the anti-aging property of the sheet steel can be much improved.

The present invention is based on those findings of the inventors.

SUMMARY OF THE INVENTION

The present invention herein provides the following:

1. Bake-hardenable sheet steel with good anti-aging property, which has a chemical composition comprising, in terms of % by weight, not larger than 0.005% of C, not larger than 1.0% of Si, not larger than 3.0% of Mn, not larger than 0.15% of P, not larger than 0.05% of S, from 0.01 to 0.20% of Al, not larger than 0.01% of N, from 0.01 to 0.2% of Ti, and optionally from 0.001 to 0.2% of Nb and/or from 0.0001 to 0.0080% of B, with a balance of Fe and inevitable impurities, and has a degree of bake hardenability (BH) of not smaller than 30 MPa, and which is characterized in that the value A defined below is not smaller than 0.4 and that the value $AI_{QUENCH}$ defined below is not smaller than 30 MPa:

$$A=(AI_{QUENCH}-AI)/AI_{QUENCH}$$

wherein;

$AI_{QUENCH}$ indicates the aging index (MPa) of the sheet steel having been heated at 500° C. for 40 seconds and then quenched in water, AI indicates the aging index (MPa) of the sheet steel, and the "aging index" indicates the increase in the yield stress (MPa) of the sheet steel, which is pre-treated to have a tensile pre-strain of 7.5% and then heated at 100° C. for 30 minutes, and this is the difference between the yield stress of the heat-treated sheet steel and that of the non-treated one.

2. Bake-hardenable sheet steel with good anti-aging property, which has a chemical composition comprising, in terms of % by weight, not larger than 0.005% of C, not larger than 1.0% of Si, not larger than 3.0% of Mn, not larger than 0.15% of P, not larger than 0.05% of S, from 0.01 to 0.20% of Al, not larger than 0.01% of N, from 0.01 to 0.2% of Ti, and optionally from 0.001 to 0.2% of Nb and/or from 0.0001 to 0.0080% of B, with a balance of Fe and inevitable impurities, and has a degree of bake hardenability (BH) of not smaller than 30 MPa, and which is characterized in that the ratio of the mean misorientation, M (degree), to the mean grain size, G ($\mu$m), M/G, is not smaller than 0.8.

3. A method for producing bake-hardenable sheet steel with good anti-aging property, which comprises hot-rolling a steel slab having a chemical composition that comprises, in terms of % by weight, not larger than 0.005% of C, not larger than 1.0% of Si, not larger than 3.0% of Mn, not larger than 0.15% of P, not larger than 0.05% of S, from 0.01 to 0.20% of Al, not larger than 0.01% of N, from 0.01 to 0.2% of Ti, and optionally from 0.001 to 0.2% of Nb and/or from 0.0001 to 0.0080% of B, with a balance of Fe and inevitable impurities, into hot-rolled sheet steel, while finishing the hot-rolling at a finishing delivery temperature ranging from 960 to 650° C. and coiling the resulting sheet steel at a coiling temperature ranging from 750 to 400° C., then cold-rolling the sheet steel to a reduction falling between 50 and 95%, and thereafter annealing it for recrystallization at a temperature falling between 700 and 920° C.

4. A method for producing bake-hardenable sheet steel with good anti-aging property, which comprises heating a steel slab having a chemical composition that comprises, in terms of % by weight, from 0.0007 to 0.0050% of C, not larger than 0.5% of Si, not larger than 2.0% of Mn, not larger than 0.10% of P, not larger than 0.008% of S, from 0.01 to 0.20% of Al, not larger than 0.01% of N, from 0.005 to 0.08% of Ti, and optionally from 0.001 to 0.015% of Nb and/or from 0.0001 to 0.0050% of B, with a balance of Fe and inevitable impurities, and with the amounts of C, Ti, N and S satisfying the following condition (1), at a temperature ($T_{SR}$) that satisfies the following condition (2), then hot-rolling it into sheet steel, while finishing the hot-rolling at a finishing delivery temperature ranging from 960 to 650° C. and coiling the resulting sheet steel at a coiling temperature ranging from 750 to 400° C., then cold-rolling the sheet steel to a reduction falling between 50 and 95%, and thereafter annealing it for recrystallization at a temperature falling between 700 and 920° C.:

$$0.5\times(C/12)\leqq Ti/48-(N/14+S/32)\leqq 4\times(C/12) \quad (1)$$

wherein C, Ti, N and S are in terms of % by weight, $$S\leqq -0.235\times T_{SR}+305 \quad (2)$$

wherein;

S indicates the sulfur content of the slab (ppm), and $T_{SR}$ indicates the slab reheating temperature (° C.).

5. Bake-hardenable sheet steel with good anti-aging property, which is characterized in that it has a chemical composition comprising, in terms of % by weight, from 0.05 to 0.02% of C, not larger than 0.5% of Si, not larger than 3.0% of Mn, not larger than 0.05% of P, not larger than 0.02% of S, from 0.01 to 0.20% of Al, not larger than 0.01% of N, from 0.025 to 0.19% of Nb, and optionally from 0.0001 to 0.005% of B and/or from 0.001 to 0.05% of Ti, with a balance of Fe and inevitable impurities, and with the amounts of C and Nb satisfying the condition defined below, and that it has a degree of bake hardenability (BH) of not smaller than 30 MPa:

$$0.7\times(C/12)\leqq Nb/93\leqq 1.2\times(C/12)$$

wherein;

C indicates the C content (% by weight), and

Nb indicates the Nb content (% by weight).

6. A method for producing bake-hardenable sheet steel with good anti-aging property, which comprises heating a steel slab having a chemical composition that comprises, in terms of % by weight, from 0.005 to 0.02% of C, not larger than 0.5% of Si, not larger than 3.0% of Mn, not larger than 0.05% of P, not larger than0.02% of S, from 0.01 to 0.20% of Al, not larger than 0.01% of N, from 0.025 to 0.19% of Nb, and optionally from 0.0001 to 0.005% of B and/or from 0.001 to 0.05% of Ti, with a balance of Fe and inevitable impurities, and with the amounts of C and Nb satisfying the condition defined below, then hot-rolling it into sheet steel, while finishing the hot-rolling at a finishing delivery temperature ranging from 960 to 650° C., then coiling the hot-rolled sheet steel at a coiling temperature ranging from 750 to 400° C., then cold-rolling it to a reduction falling between 50 and 95%, and thereafter annealing it for recrystallization at a temperature falling between 750 and 920° C.:

$$0.7\times(C/12)\leqq Nb/93\leqq 1.2\times(C/12)$$

wherein;

C indicates the C content (% by weight), and

Nb indicates the Nb content (% by weight).

DESCRIPTION OF PREFERRED EMBODIMENTS OF THE INVENTION

Figure 1:
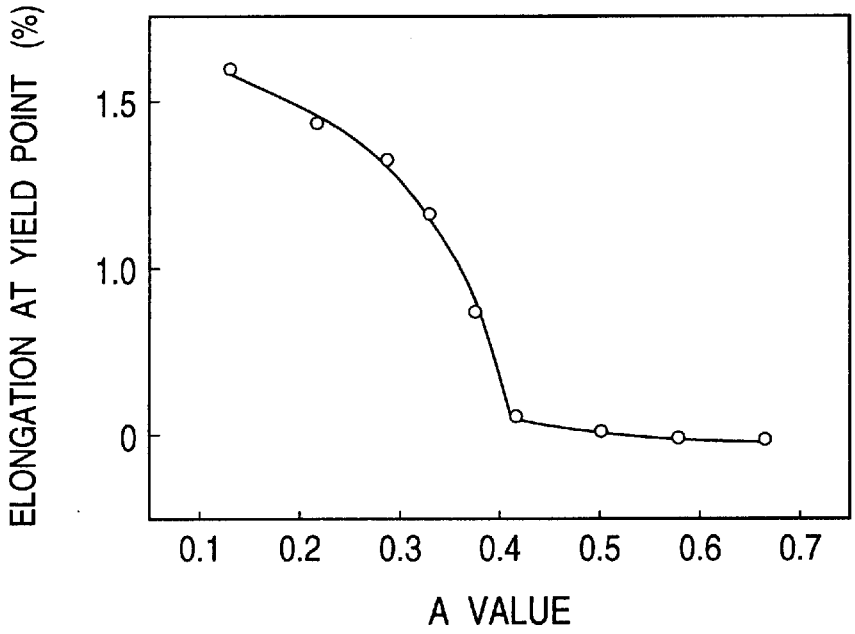
FIG. 1 is a graph showing the influence of the value A of sheet steel on the elongation thereof at its yield point.

Herein under described are experiments which we, the inventors made, and their data, on which the present invention is based.

One experiment which we, the inventors made is as follows: Prepared were sheet bars each having a composition comprising 0.0020 wt. % of C, 0.02 wt. % of Si, 0.1 wt. % of Mn, 0.01 wt. % of P, from 0.005 to 0.015 wt. % of S, 0.04 wt. % of Al, 0.002 wt. % of N, from 0 to 0.075 wt. % of Ti and from 0 to 0.025 wt. % of Nb, and these were heated and soaked at a temperature falling between 950 and 1250° C., and then subjected to 3-pass hot-rolling in such a manner that the finishing delivery temperature might be 900° C. to give hot-rolled bands each having a thickness of 3.5 mm, and thereafter coiled at a coiling temperature of 600° C. over a period of 1 hour. Next, these hot-rolled bands were cold-rolled to a reduction of 80%, and then annealed for recrystallization at a temperature falling between 800 and 880° C. for 40 seconds. Of the cold-rolled and annealed bands, those having found to have a degree of BH of from 35 to 45 MPa were aged at 100° C. for 10 hours, and their elongation at their yield point was measured. To obtain the degree of BH of each band, a tensile pre-strain of 2% was imparted to each band, which was then heated at 170° C. for 20 minutes. The difference between the yield stress of the heated band and that of the non-heated one was obtained, which indicates the degree of BH of the band. The aging treatment at 100° C. for 10 hours corresponds to that at room temperature for about 6 months. It is known that the anti-aging property of the bands having a degree of yield point elongation of not larger than 0.2% after the aging treatment is good.

As in FIG. 1, our experiment gave the result that the steel bands having been aged at 100° C. for 10 hours have a degree of yield point elongation of not larger than 0.2% when the value A is not smaller than 0.4. This means that the aged steel bands having a value A of not smaller than 0.4 have a good anti-aging property.

The value A is represented by:

$$A=(AI_{QUENCH}-AI)/AI_{QUENCH}$$

wherein $AI_{QUENCH}$ indicates the aging index (MPa) of the steel band having been cold-rolled, annealed, heated at 500° C. for 40 seconds and then quenched in water; AI indicates the aging index (MPa) of the steel band having been cold-rolled and annealed; and the "aging index" indicates the increase in the yield stress (MPa) of the cold-rolled and annealed steel band, which was pre-treated to have a tensile pre-strain of 7.5% and then heated at 100° C. for 30 minutes, and this is the difference between the yield stress of the heat-treated steel band and that of the non-treated one.

The intragranular and intergranular solute C existing inside and around the grains in steel is proportional to the value $AI_{QUENCH}$ of the steel and corresponds to the degree of BH thereof. The amount of the intergranular solute C existing around the grains in steel is proportional to the value, $(AI_{QUENCH}-AI)$ of the steel. Accordingly, the ratio of the intergranular solute C to the overall solute C in steel is represented by the value A, $A=(AI_{QUENCH}-AI)/AI_{QUENCH}$.

Based on these findings, we have reached the result that sheet steel having good anti-aging property and having good bake-hardenability can be produced by specifically controlling the condition of solute C existing inside and around the grains in the steel.

Thus, the invention herein provides bake-hardenable sheet steel with good anti-aging property, which has a chemical composition comprising, in terms of % by weight, not larger than 0.005% of C, not larger than 1.0% of Si, not larger than 3.0% of Mn, not larger than 0.15% of P, not larger than 0.05% of S, from 0.01 to 0.20% of Al, not larger than 0.01% of N, and from 0.01 to 0.2% of Ti, with a balance of Fe and inevitable impurities, and has a value A of not smaller than 0.4 and a value $AI_{QUENCH}$ of not smaller than 30.

In this, $A=(AI_{QUENCH}-AI)/AI_{QUENCH}$ wherein $AI_{QUENCH}$ indicates the aging index (MPa) of the sheet steel having been cold-rolled, annealed, heated at 500° C. for 40 seconds and then quenched in water; AI indicates the aging index (MPa) of the sheet steel having been cold-rolled and annealed; and the "aging index" indicates the increase in the yield stress (MPa) of the cold-rolled and annealed sheet steel, which was. pre-treated to have a tensile pre-strain of 7.5% and then heated at 100° C. for 30 minutes, and this is the difference between the yield stress of the heat-treated sheet steel and that of the non-treated one.

The sheet steel of the invention may optionally contain, in addition to the chemical composition noted above, from 0.001 to 0.2% of Nb and/or from 0.0001 to 0.0080% of B, in terms of % by weight.

The invention also provides a method for producing bake-hardenable sheet steel with good anti-aging property, which comprises subjecting a steel slab having a chemical composition that comprises, in terms of % by weight, not larger than 0.005% of C, not larger than 1.0% of Si, not larger than 3.0% of Mn, not larger than 0.15% of P, not larger than 0.05% of S, from 0.01 to 0.20% of Al, not larger than 0.01% of N, and from 0.01 to 0.2% of Ti, with a balance of Fe and inevitable impurities, to hot-rolling and cold-rolling to give cold-rolled sheet steel, and thereafter annealing the resulting sheet steel to make the it have a value $AI_{QUENCH}$ of not smaller than 30 and a value A of not smaller than 0.4. In this, those values $AI_{QUENCH}$ and A have the same meanings as above. In this method of the invention, the steel slab may optionally contain, in addition to the chemical composition noted above, from 0.001 to 0.2% of Nb and/or from 0.0001 to 0.0080% of B, in terms of by weight.

Another experiment which we, the inventors made is as follows: Prepared were sheet bars each having a composition comprising 0.0025 wt. % of C, 0.02 wt. % of Si, 0.1 wt. % of Mn, 0.01 wt. % of P, 0.003 wt. % of S, 0.04 wt. % of Al, 0.002 wt. % of N and from 0 to 0.075 wt. % of Ti, and these were heated and soaked at 1050° C., and then subjected to 3-pass hot-rolling in such a manner that the finishing delivery temperature might be 900° C. to give hot-rolled bands each having a thickness of 3.5 mm, which were then coiled at a coiling temperature of 600° C. over a period of 1 hour. Next, these hot-rolled bands were cold-rolled to a reduction of 80%, and then annealed for recrystallization at a temperature falling between 750 and 880° C. for 40 seconds. The degree of uniform elongation and the degree of BH of those cold-rolled and annealed bands were measured. To obtain the degree of BH of each band, a tensile pre-strain of 2% was first imparted to each band, which was then heated at 170° C. for 20 minutes. The difference between the yield stress of the heat-treated band and that of the non-treated one was obtained, which indicates the degree of BH of the band.

Of the cold-rolled and annealed bands, those having a degree of BH of 30 MPa or more, that is, BH≧30 MPa, were tested to measure the degree of uniform elongation, the yield point elongation, the mean grain size, G (μm), and the mean misorientation, M (degree), of those bands. The degree of uniform elongation was measured in a tensile test using JIS No. 5 tension test pieces of each band. The yield point elongation indicates the degree of elongation at its yield point of each band having been aged at 100° C. for 10 hours. The aging treatment at 100° C. for 10 hours corresponds to that at room temperature for about 6 months. It is known that the anti-aging property of the bands having a degree of yield point elongation of not larger than 0.2% after the aging treatment is good. To determine the mean grain size, G (μm), test pieces were sampled at random from three sites of each steel band, and the cross section of each test piece was observed with an optical microscope to measure the grain size of the grains seen in the cross section. The data were averaged to obtain the mean grain size. To determine the mean misorientation, the electron back scattering diffraction pattern (EBSD) was obtained through scanning electron microscope observation of the cross section of each of those test pieces, and the orientation of each grain was measured. Precisely, 50 or more grains in one test piece were measured to obtain the orientational difference (inclined angle) between the adjacent grain boundaries in each test piece. The data were averaged to obtain the mean value.

Figure 2:
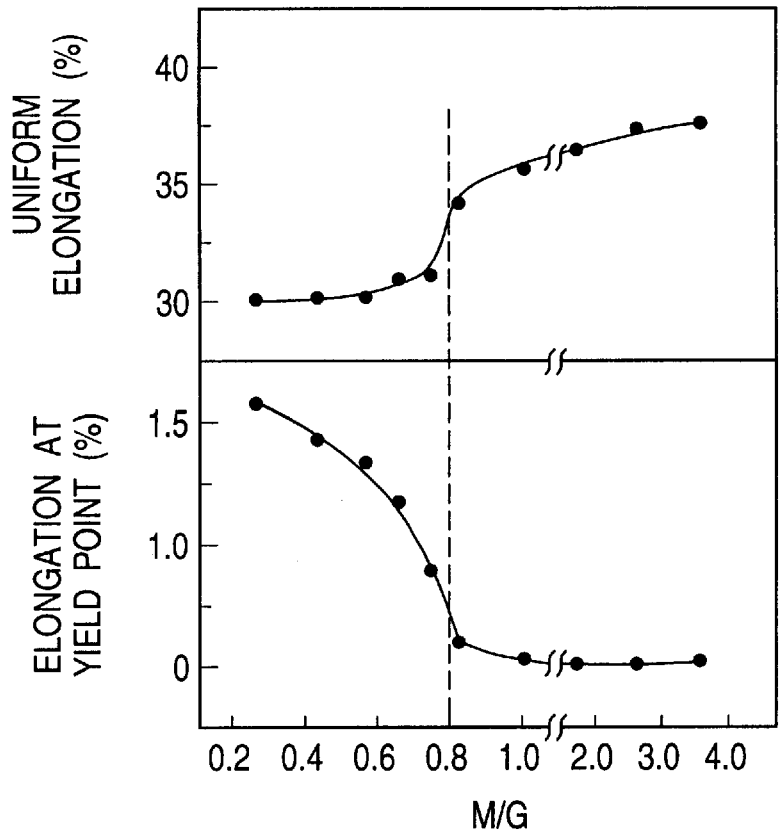
FIG. 2 is a graph showing the influence of the ratio, M/G, of sheet steel on the ductility for uniform elongation thereof and on the elongation thereof at its yield point.

As in FIG. 2, our experiment gave the result that the steel bands having been aged at 100° C. for 10 hours have a degree of yield point elongation of not larger than 0.2% and have a degree of uniform elongation of not smaller than 34%, when the ratio, M/G is not smaller than 0.8. This our finding means that the steel bands having a ratio, M/G, of not smaller than 0.8 have a good anti-aging property and have good ductility for uniform elongation, or that is, good press formability, even when they have a high degree of BH of not lower than 30 MPa.

Based on this finding, we have reached the result that sheet steel having both good ductility for uniform elongation and good anti-aging property while still having good bake-hardenability can be produced by specifically defining the ratio of the misorientation to the grain size in the sheet steel.

Thus, the invention herein provides bake-hardenable sheet steel with good press formability and good anti-aging property, which has a chemical composition comprising, in terms of % by weight, not larger than 0.005% of C, not larger than 1.0% of Si, not larger than 3.0% of Mn, not larger than 0.15% of P, not larger than 0.05% of S, from 0.01 to 0.20% of Al, not larger than 0.01% of N, and from 0.01 to 0.2% of Ti, with a balance of Fe and inevitable impurities, and which has a ratio of the misorientation, M (degree), to the meangrainsize, G (μm), M/G, of not smaller than 0.8 and has a degree of bake-hardenability (BH) of not smaller than 30 MPa. The sheet steel of the invention may optionally contain, in addition to the chemical composition noted above, from 0.001 to 0.2% of Nb and/or from 0.0001 to 0.0080% of B, in terms of % by weight.

The invention also provides a method for producing bake-hardenable sheet steel with good press formability and good anti-aging property, which comprises subjecting a steel slab having a chemical composition that comprises, in terms of % by weight, not larger than 0.005% of C, not larger than 1.0% of Si, not larger than 3.0% of Mn, not larger than 0.15% of P, not larger than 0.05% of S, from 0.01 to 0.20% of Al, not larger than 0.01% of N, from 0.01 to 0.2% of Ti, and optionally from 0.001 to 0.2% of Nb and/or from 0.0001 to 0.0080% of B, with a balance of Fe and inevitable impurities, to a hot-rolling step of heating it preferably at a temperature ranging between 1300 and 900° C., then rolling it preferably to a cumulative reduction of not smaller than 70%, and then coiling it preferably while acceleratively cooling it, to give sheet steel, and then subjecting the resulting sheet steel to a cold-rolling step of cold-rolling it preferably to a reduction of not smaller than 70%, and thereafter annealing the resulting sheet steel preferably at a temperature of lower than 880° C. but not lower than 750° C. to thereby make it have a ratio of the mean misorientation, M (degree), to the mean grain size, G (μm), M/G, of not smaller than 0.8.

Still another experiment which we, the inventors made is as follows: Prepared were sheet bars each having a composition comprising 0.0020 wt. % of C, 0.02 wt. % of Si, 0.10 wt. % of Mn, 0.01 wt. % of P, from 0.0005 to 0.013 wt. % of S, 0.04 wt. % of Al, 0.0020 wt. % of N, from 0.02 to 0.04 wt. % of Ti and 0.0015 wt. % of B, and satisfying the condition of $\{Ti/48-(N/14+S/32)\}\approx 1.5\times(C/12)$, and these were heated and soaked at a temperature falling between 950 and 1250° C., and then subjected to 3-pass hot-rolling in such a manner that the finishing delivery temperature might be 890° C. to give hot-rolled bands each having a thickness of 3.5 mm, and thereafter coiled at a coiling temperature of 600° C. over a period of 1 hour. Next, these hot-rolled bands were cold-rolled to a reduction of 80%, and then annealed for recrystallization at 830° C. for 40 seconds.

Those cold-rolled and annealed bands were tested to measure their AI and BH.

AI indicates the aging index of each steel band. To obtain its aging index, each steel band was pre-treated to have a tensile pre-strain of 7.5% and then heated at 100° C. for 30 minutes, and the increase in the yield stress (MPa) of the heat-treated steel band, or that is, the difference between the yield stress of the heat-treated steel band and that of the non-treated one was obtained. From the thus-obtained yield stress, obtained was the aging index of the steel band. To obtain the degree of BH of each band, a tensile pre-strain of 2% was first imparted to each band, which was then heated at 170° C. for 20 minutes. The increase in the yield stress (MPa) of the heat-treated band, or that is, the difference between the yield stress of the heat-treated band and that of the non-treated one was obtained, which indicates the degree of BH of the band.

Figure 3:
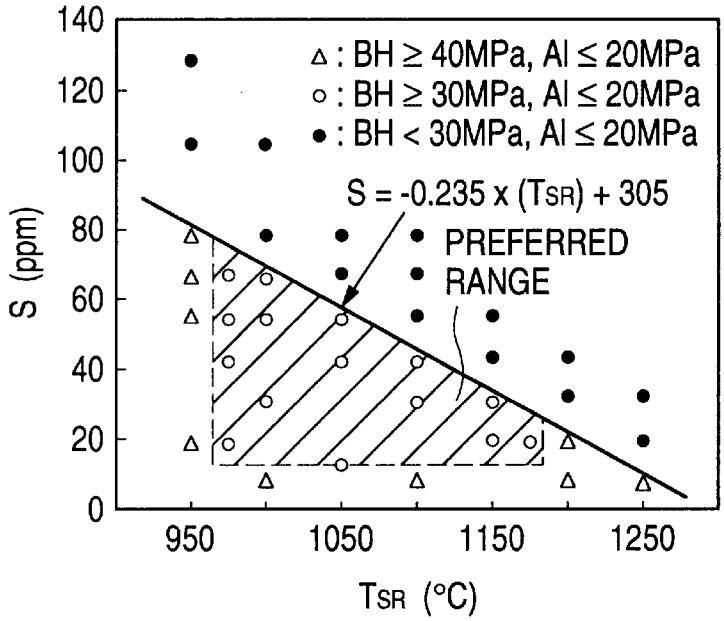
FIG. 3 is a graph showing the influence of the slab reheating temperature ($T_{SR}$) and that of the S content of steel on the degree of BH of sheet steel and on the value AI thereof.

The influence of the slab reheating temperature ($T_{SR}$) and that of the S content of the sheet bar on the value AI and the value BH of the sheet bar is shown in FIG. 3.

As in FIG. 3, it is known that the value AI and the value BH of each sheet bar both depend on the temperature, $T_{SR}$, and the S content of the sheet bar. Precisely, it is known therefrom that, only when the temperature $T_{SR}$ and the S content satisfy the condition ojf $S\leqq -0.235\times T_{SR}+305$, the value BH is not smaller than 30 MPa and the value AI is not larger than 20 MPa. In particular, it is known therefrom that, when the temperature $T_{SR}$ and the S content satisfy the condition of $S\leqq -0.235\times T_{SR}+305$ in which $T_{SR}$ is higher than 950° C. but lower than 1200° C. and the S content is larger than 10 ppm, then the value BH is not smaller than 40 MPa and the value AI is not larger than 20 MPa, or that is, the sheet steel obtained under the specifically defined condition shall have good BH-ability and good anti-aging property.

Thus, the invention herein provides a method for producing bake-hardenable sheet steel with good anti-aging property, which comprises heating a steel slab having a chemical composition that comprises, in terms of % by weight, from 0.0007 to 0.0050% of C, not larger than 0.5% of Si, not larger than 2.0% of Mn, not larger than 0.10% of P, not larger than 0.008% of S, from 0.01 to 0.20% of Al, not larger than 0.01% of N, and from 0.005 to 0.08% of Ti, with a balance of Fe and inevitable impurities, and with the amounts of C, Ti, N and S satisfying the following condition (1), at a temperature ($T_{SR}$) that satisfies the following condition (2), then hot-rolling it into sheet steel, while finishing the hot-rolling at a finishing delivery temperature ranging from 960 to 650° C. and coiling the resulting sheet steel at a coiling temperature ranging from 750 to 400° C., then cold-rolling the sheet steel to a reduction falling between 50 and 95%, and thereafter annealing it for recrystallization at a temperature falling between 700 and 920° C.:

$$0.5\times(C/12)\leqq Ti/48-(N/14+S/32)\leqq 4\times(C/12) \quad (1)$$

wherein C, Ti, N and S are in terms of % by weight, $$S\leqq -0.235\times T_{SR}+305 \quad (2)$$

wherein;

S indicates the sulfur content of the slab (ppm), and $T_{SR}$ indicates the slab reheating temperature (° C.). Here, $T_{SR}$ is preferably higher than 950° C. but lower than 1200° C. Also, the S content of the steel slab is preferably larger than 10 ppm.

In the method of the invention, the steel slab may optionally contain, in addition to the chemical composition noted above, from 0.001 to 0.015% of Nb and/or from 0.0001 to 0.005% of B, in terms of % by weight.

Still another experiment which we, the inventors made is as follows: Prepared were sheet bars each having a composition comprising 0.008 wt. % of C, 0.02 wt. % of Si, 0.1 wt. % of Mn, 0.006 wt. % of S, 0.04 wt. % of Al, and 0.002 wt. % of N, and containing a varying amount of from 0.01 to 0.08 wt. % of P and a varying amount of from 0.025 to 0.096 wt. % of Nb, and these. were heated and soaked at 1150° C., then subjected to 3-pass hot-rolling in such a manner that the finishing delivery temperature might be 900° C., and thereafter coiled at a coiling temperature of 600° C. over a period of 1 hour to give hot-rolled bands each having a thickness of 3.5 mm. Next, these hot-rolled bands were cold-rolled to a reduction of 80%, then annealed for recrystallization at 800° C. for 40 seconds, and thereafter skinpass-rolled to a reduction of 0.8%. The BH-ability and the aging property of those bands were measured. The data are shown in Table 4. To obtain the degree of BH of each band, a tensile pre-strain of 2% was first imparted to each band, which was then heated at 170° C. for 20 minutes. The increase in the yield stress of the heat-treated band, or that is, the difference between the yield stress of the heat-treated band and that of the non-treated one was obtained, which indicates the BH-ability of the band. To measure the room temperature-aging property of each band, the band was heated at 100° C. for 10 hours, and the elongation of the heated band at its yield point was measured. This indicates the room temperature-aging property of the band.

Figure 4:
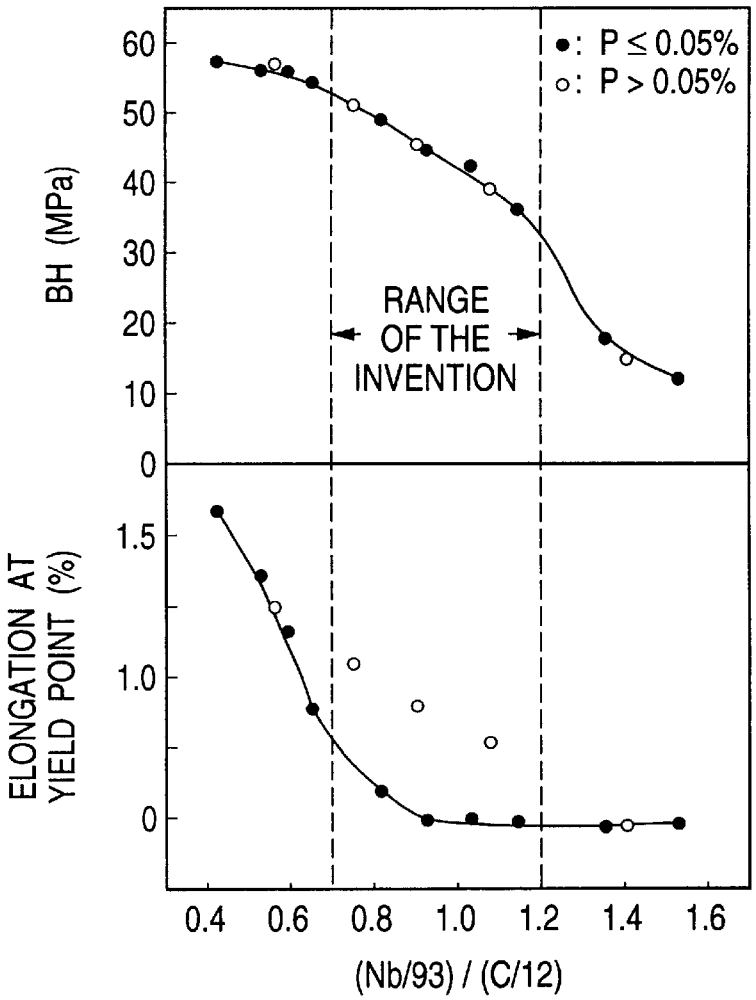
FIG. 4 is a graph showing the influence of the ratio, Nb/C of steel on the yield point elongation of sheet steel and on the degree of BH thereof.

From FIG. 4, it is known that, when the P content of each steel band is not larger than 0.05% by weight and when the ratio, (Nb/93)/(C/12) thereof falls between 0.7 and 1.2, the degree of BH of each steel band is not smaller than 30 MPa and the yield point elongation of the same having been aged is not larger than 0.2%. This means that the sheet steel having a specifically-defined P content and having a specifically-defined ratio, (Nb/93)/(C/12) shall have good BH-ability and good anti-aging property.

Thus, the invention herein provides bake-hardenable sheet steel with good anti-aging property, which has a chemical composition comprising, in terms of % by weight, from 0.005 to 0.02% of C, not larger than 0.5% of Si, not larger than 3.0% of Mn, not larger than 0.05% of P, not larger than 0.02% of S, from 0.01 to 0.20% of Al, not larger than 0.01% of N, and from 0.025 to 0.19% of Nb, with a balance of Fe and inevitable impurities, and with the amounts of C and Nb satisfying the condition defined below, and which has a degree of bake hardenability (BH) of not smaller than 30 MPa:

$$0.7\times(C/12)\leqq Nb/93\leqq 1.2\times(C/12)$$

wherein;

C indicates the C content (% by weight), and

Nb indicates the Nb content (% by weight).

The sheet steel of the invention may optionally contain, in addition to the chemical composition noted above, from 0.0001 to 0.005% of B and/or from 0.001 to 0.05% of Ti, in terms of % by weight.

The invention also provides a method for producing bake-hardenable sheet steel with good anti-aging property, which comprises heating a steel slab having a chemical composition comprising, in terms of % by weight, from 0.005 to 0.02% of C, not larger than 0.5% of Si, not larger than 3.0% of Mn, not larger than 0.05% of P, not larger than 0.02% of S, from 0.01 to 0.20% of Al, not larger than 0.01% of N, and from 0.025 to 0.19% of Nb, with a balance of Fe and inevitable impurities, and with the amounts of C and Nb satisfying the condition of:

$$0.7\times(C/12)\leqq Nb/93\leqq 1.2\times(C/12)$$

wherein;

C indicates the C content (% by weight), and

Nb indicates the Nb content (% by weight), then hot-rolling it into hot-rolled sheet steel, while finishing the hot-rolling at a finishing delivery temperature ranging from 960 to 650° C. and coiling the resulting sheet steel at a coiling temperature ranging from 750 to 400° C., then cold-rolling the sheet steel to a reduction falling between 50 and 95%, and thereafter annealing it for recrystallization at a temperature falling between 750 and 920° C. In this method of the invention, the steel slab may optionally contain, in addition to the chemical composition noted above, from 0.0001 to 0.005% of B and/or from 0.001 to 0.05% of Ti.

The reasons for the numerical limitations in the constitution of the invention are mentioned below.

First referred to is the value A. A is as follows:

$A=(AI_{QUENCH}-AI)/AI_{QUENCH}$, which is not smaller than 0.4.

$AI_{QUENCH}$ is not smaller than 30 MPa.

The value A indicates the ratio of the intergranular solute C existing around the grains to the overall solute C existing inside and around the grains in steel; and AI is the aging index of cold-rolled and annealed sheet steel. If having $AI_{QUENCH}$ of not smaller than 30 MPa and having A of not smaller than 0.4, sheet steel shall have both a high degree of bake-hardenability (BH-ability) of not smaller than 30 MPa and good anti-aging property. Sheet steel having $AI_{QUENCH}$ of not smaller than 30 MPa may have a high degree of BH of not lower than 30 MPa. However, if its value A is smaller than 0.4, sheet steel could not have both good BH-ability and good anti-aging property even though its chemical composition is optimized.

As mentioned hereinabove, we, the present inventors have found that, in sheet steel, the solute C capable of expressing its BH-ability and the solute C participating in its room temperature-aging property exist in different sites, or that is, the former exists inside and around the grains everywhere in steel and shall be derived from the value $AI_{QUENCH}$, while the latter exists only inside the grains of steel and shall be derived from the value ($AI_{QUENCH}$−AI). During low-temperature aging, such as room temperature-aging, of sheet steel, the intergranular solute C existing around the grains of steel is kept trapped in the grain boundaries and could not diffuse into the grains; but during high-temperature heat-treatment, such as paint-baking, of sheet steel, even the intergranular solute C existing around the grains can diffuse into the depth of the grains, and therefore can participate in improving the BH-ability of the sheet steel.

In the method of producing sheet steel of the invention, the steel slab having a specifically-defined chemical composition as above is hot-rolled and then cold-rolled, and thereafter the resulting sheet steel is then annealed to make it have a value A of not smaller than 0.4 and a value $AI_{QUENCH}$ of not smaller than 30 MPa. In this, in order to make the sheet steel have a value $AI_{QUENCH}$ of not smaller than 30 MPa, a steel slab having a specifically-defined chemical composition as above is prepared, and the fine carbide existing therein are dissolved in the annealing step, or the solute C existing therein is made to remain in the hot-rolled sheet steel. From the viewpoint of the deep drawability of the sheet steel formed, the former is preferred. In order to dissolve the fine carbide, it is desirable that the annealing temperature is controlled to be not lower than 780° C.

In order to make the sheet steel produced have a value A of not smaller than 0.4, it is desirable that the annealing temperature is low, preferably to be lower than 880° C. but not lower than 780° C. If the annealing temperature is too high, there will be almost no difference between the intergranular energy and the intragranular energy in steel, resulting in that the intergranular solute C existing around the grains in steel will diffuse into the grains to thereby lower the value A of the sheet steel. In order to increase the intergranular solute C existing around the grains in steel, the annealing temperature must be low.

Next referred to is the ratio of the misorientation, M (degree), to the mean grain size, G (μm), M/G, in the sheet steel of the invention.

The ratio of the misorientation, M (degree), to the mean grain size, G (μm), M/G, shall be not smaller than 0.8. MIG of not smaller than 0.8 increases the amount of the intergranular solute C existing around the grains in sheet steel. This is because, enlarging the ratio M/C, or that is, making the grains in sheet steel finer to thereby increase the degree of misorientation enlarges the area of the grain boundaries in the sheet steel, whereby much solute C can easily move toward the grain boundaries and an increased amount of solute C can exist in the grain boundaries. In addition, a larger amount of solute C may exist in grain boundaries in sheet steel having a larger degree of misorientation. Sheet steel having M/G of not smaller than 0.8 shall have a larger amount of intergranular solute C existing in grain boundaries, even though the overall amount of solute C in the sheet steel is so large as to make the sheet steel have a degree of BH of 30 MPa or larger, resulting in that the sheet steel is, after having been rolled, to have a lowered degree of yield elongation and that the anti-aging property of the sheet steel is improved.

In addition, the ductility for uniform elongation of sheet steel having M/G of not smaller than 0.8 is increased. To increase the ductility for uniform elongation of sheet steel, it is important that the strain resulting from tensile deformation of the sheet steel is unified throughout the sheet steel. For this, we, the present inventors have found that the ratio of the misorientation to the grain size in sheet steel is critical, and that, when the ratio in question is enlarged, for example, by reducing the grain size while enlarging the degree of misorientation, then the strain, if imparted to sheet steel, can be unified throughout the sheet steel. After having made many experiments based on this finding, we have reached the result that the. critical lowermost value of the ratio of misorientation to the grain size, M/G, in sheet steel is 0.8. Sheet steel having M/G of smaller than 0.8 could not have a high degree of BH of not smaller than 30 MPa as noted above and could not have both good ductility for uniform elongation and good anti-aging property.

In the method for producing the intended sheet steel of the invention, a steel slab having the specific chemical composition defined above is hot-rolled and then cold-rolled into sheet steel, and thereafter the resulting sheet steel is annealed to make it have M/G of not smaller than 0.8. The factors having influences on the ratio M/G include the grain size in the hot-rolled sheet steel, the reduction for the cold-rolling, and the annealing temperature. In order to make the sheet steel have M/G of not smaller than 0.8, the grain size in the hot-rolled sheet steel must be small, the reduction for the cold-rolling must be high, and the annealing must be effected at low temperatures. If the annealing temperature is too high, the grains shall grow too much whereby the mean grain size in the annealed sheet steel will be too large. If so, in addition, the growing grains will aggregate into large grains to lower the intergranular energy in steel whereby the misorientation, M, is reduced, resulting in that the ratio, M/G, is reduced. On the other hand, however, if the annealing temperature is too low, the amount of the solute C enough to make the annealed sheet steel have a degree of BH of not smaller than 30 MPa will be unfavorably lowered. For these reasons, desirably, fine carbide capable of being dissolved at low temperatures are formed during the hot-rolling step and those carbide are dissolved at low temperatures in the annealing step, in order to obtain the intended sheet steel having BH of not smaller than 30 MPa and having M/G of not smaller than 0.8.

In the invention, steel is defined to have a specific chemical composition as noted above, for which the reasons are described below.

Regarding C:

C is an element having some negative influences on the deep drawability of sheet steel. Therefore, it is desirable to reduce the amount of C as much as possible. Steel that indispensably contains Ti may contain C in an amount of at most up to 0.0050%. Accordingly, in the invention, the uppermost limit of the C content of the steel of that type is 0.0050%. On the other hand, steel that indispensably contains Nb must contain C in an amount of not smaller than 0.005%, since C acts on Nb to give a suitable amount of NbC precipitate in the steel thereby making the grains constituting the steel fine and increasing the intergranular solute C to improve the anti-aging property of the steel. However, of the steel of that type, if the C content is larger than 0.02%, the deep drawability of the steel is lowered. Accordingly, in the invention, the C content of the steel of that type is defined to be not larger than 0.02%

Regarding Si:

Si acts to increase the strength of steel, and is added in accordance with the intended strength of steel. However, if its amount added is larger than 1.0%, the deep drawability of steel is lowered. Therefore, in the invention, the Si content of steel is defined to be not larger than 1.0%. In order to ensure better deep drawability of steel, the Si content is preferably not larger than 0.5%.

Regarding Mn:

Mn acts to increase the strength of steel, and is added in accordance with the intended strength of steel. However, if its amount added is larger than 3.0%, the deep drawability of steel is lowered. Therefore, in the invention, the Mn content of steel is defined to be not larger than 3.0%. In order to ensure better deep drawability of steel, the Mn content is preferably not larger than 2.0%.

Regarding P:

P acts to reinforce steel, and is added in accordance with the intended strength of steel. However, if its amount added is larger than 0 15%, the deep drawability of steel is lowered. Therefore, in the invention, the P content of steel is defined to be not larger than 0.15%. In order to ensure better deep drawability of steel, the P content is preferably not larger than 0.10%. Further, in order to enlarge the intergranular C in steel, the P content is more preferably not larger than 0.05%.

Regarding S:

S is an element having some negative influences on the deep drawability of steel. Therefore, it is desirable to reduce the amount of S as much as possible, but the S content may be up to 0.05%. In order to ensure better deep drawability of steel, the S content is preferably not larger than 0.02%. In steel that indispensably contains Ti, S has influences on the BH-ability and the anti-aging property of the steel. Of the steel of that type, therefore, it is critical that the S content is not larger than 0.008% and is defined to be not larger than $(-0.235\times T_{SR}+305)$ (ppm) in relation to the slab reheating temperature, $T_{SR}$. If its S content is larger than $(-0.235\times T_{SR}+305)$ (ppm), the sheet steel could not have a high degree of BH of not smaller than 30 MPa and a low AI value of not larger than 20 MPa. In order to obtain sheet steel having a high degree of BH of not smaller than 40 MPa and a low AI value of not larger than 20 MPa, its S content is preferably not smaller than 0.0010%.

Regarding Al:

Al is added to steel for deoxidation and for improving the yield of carbonitride-forming elements. If its content is lower than 0.01%, Al is ineffective. However, even if Al is added in an amount of larger than 0.20%, its effect will be no more enhanced. Therefore, in the invention, the Al content of steel is defined to fall between 0.01 and 0.20%.

Regarding N:

N is an element having some negative influences on the deep drawability of steel. Therefore, it is desirable that the N content is as small as possible. As being acceptable, the N content is herein defined to be not larger than 0.01%.

Regarding Ti:

Ti reacts with C in steel to give its carbide precipitate, thereby preventing the deep drawability of steel from being lowered by the solute C existing in steel. If its content is lower than 0.001%, Ti is ineffective. However, even if Ti is added in an amount of larger than 0.2%, its effect will be no more enhanced, and the deep drawability of steel containing such a large amount of Ti will be lowered. Therefore, in the invention, the Ti content is defined to fall between 0.001 and 0.2%. Of steel that indispensably contains Ti, preferably, the Ti content falls between 0.005 and 0.08%, while satisfying the following condition relative to the amounts of C, N and S therein:

$$0.5\times(C/12)\leqq Ti/48-(N/14+S/32)\leqq 4\times(C/12)$$

If the value of $\{Ti/48-(N/14+S/32)\}$ is lower than $\{0.5\times(C/12)\}$, too much solute C remains in the hot-rolled sheet steel to worsen the deep drawability of the cold-rolled and annealed sheet steel. On the other hand, if $\{Ti/48-(N/14+S/32)\}$ is larger than $\{4\times(C/12)\}$, the carbides could hardly dissolve during the annealing step so that the BH-ability of the annealed sheet steel is lowered. For these reasons, $\{Ti/48-(N/14+S/32)\}$ preferably falls between $\{0.5\times(C/12)\}$ and $\{4\times(C/12)\}$.

Regarding Nb:

In steel that indispensably contains Ti, Nb acts to make the hot-rolled sheet steel have a fine texture and to increase the r value of the cold-rolled and annealed sheet steel. In addition, it further acts to make the cold-rolled and annealed sheet steel have fine grains, thereby increasing the ratio of the intergranular solute C to the overall solute C. Nb exhibits these effects, when added in an amount of 0.001% or more. However, even if Nb is added in an amount of larger than 0.2%, its effects could no more be enhanced and the deep drawability of the sheet steel containing such a large amount of Nb will be poor. Accordingly, the Nb content is herein defined to fall between 0.001 and 0.2%.

In steel that indispensably contains Nb, Nb acts to stabilize the solute C therein to give fine NbC precipitate, while acting to grow the recrystallized {111} grains during the step of annealing for recrystallization, to thereby improve the deep drawability of the annealed sheet steel. The fine NbC precipitate formed prevents the grain growth in the annealing step, resulting in that the grains may still be fine and the intergranular C is increased after the annealing. As a result, the anti-aging property of the annealed sheet steel is improved. Moreover, the NbC precipitate is dissolved during the annealing step to increase the solute C in the annealed sheet steel, whereby the BH-ability of the annealed sheet steel is improved.

In order that Nb exhibits those effects, its content must satisfy the following condition relative to the C content in the steel:

$$0.7\times(C/12)\leqq Nb/93\leqq 1.2\times(C/12)$$

wherein;

C indicates the C content (% by weight), and

Nb indicates the Nb content (% by weight).

If Nb/93 is lower than 0.7×(C/12), too much solute C will exist in the steel, resulting in that the intragranular solute C is too much increased and that the anti-aging property of the sheet steel is lowered. On the other hand, if Nb/93 is larger than 1.2×(C/12), NbC could not be dissolved during the annealing step, resulting in that the solute C content of the steel is lowered. If so, the sheet steel could not have a degree of BH of not smaller than 30 MPa.

In addition to the essential components noted above, the sheet steel of the invention may further contain an additional component B.

Regarding B:

B acts to prevent secondary working embrittlement of steel. For this, B must be added in an amount of not smaller than 0.0001%. However, if the B content is larger than 0.0080%, the deep drawability of steel is lowered. Therefore, the B content is defined to fall between 0.0001 and 0.0080%.

In the invention, steel contains Fe and inevitable impurities as the balance of the constituent components. For the inevitable impurities, for example, steel may contain O in an amount of not larger than 0.010%.

Now, the conditions for producing the sheet steel of the invention are mentioned below.

The hot-rolling step and the cold-rolling step in the production method of the invention are not specifically defined, for which the preferred conditions are mentioned below.

A steel slab is hot-rolled under heat at a temperature not higher than 1300° C. In order to stabilize the solute C and N as their precipitates in the hot-rolled sheet steel to thereby improve the deep drawability of the steel, it is desirable that the heating temperature is as low as possible. However, if the heating temperature is lower than 900® C., the workability of the sheet steel could not be improved, but rather the rolling load for the hot rolling is increased to cause some troubles in the hot-rolling step. Therefore, the hot-rolling temperature is preferably between 900 and 1300° C., more preferably between 950 and 1150° C.

It is desirable that a steel slab that indispensably contains Ti is heated under the condition mentioned below, in order to increase the intergranular C in the steel and to improve the anti-aging property of the rolled sheet steel.

$$S \leqq -0.235 \times T_{SR} + 305$$

wherein,

S indicates the sulfur content of the steel (ppm), and $T_{SR}$ indicates the slab reheating temperature (° C.).

It is believed that, where the slab is heated at $T_{SR}$ that satisfies the condition noted above, sulfides and carbides are precipitated not in the form of carbosulfide composites but in the form of essentially fine carbide in the heated steel, in which the fine carbide are dissolved at low temperatures in the step of annealing it for recrystallization, resulting in that a large amount of intergranular solute C may remain around the grains in the annealed sheet steel. In this preferred case, therefore, the sheet steel obtained shall have a lowered AI value and an increased degree of BH.

If, however, the steel slab is heated at $T_{SR}$ not satisfying the condition noted above, the sheet steel obtained could not have a degree of BH of not smaller than 30 MPa. In order to make the sheet steel have a higher degree of BH (40 MPa or higher), more preferably, $T_{SR}$ is higher than 950° C. but lower than 1200° C.

Next, the thus-heated steel slab is hot-rolled into hot-rolled sheet steel, while finishing the hot-rolling at a finishing delivery temperature ranging from 960 to 650° C. and coiling the resulting sheet steel at a coiling temperature ranging from 750 to 400° C.

If the finishing delivery temperature at which the hot-rolling is finished is higher than 960° C., the grains constituting the hot-rolled sheet steel will be coarse, resulting in that the deep drawability of the cold-rolled and annealed sheet steel is lowered. If, on the other hand, the finishing delivery temperature is lower than 650° C., the deformation resistance of the sheet steel being hot-rolled is enlarged, resulting in that the steel requires an enlarged rolling load and the hot-rolling of the steel is difficult. Therefore, the finishing delivery temperature is defined to range from 960 to 650° C.

In order to make the hot-rolled sheet steel have fine grains having a small grain size, it is desirable that the sheet steel is acceleratively cooled immediately after the finish of the hot-rolling. For acceleratively cooling it, the hot-rolled sheet steel is cooled within 1 second after the finish of the hot-rolling, whereby the grains constituting it may be fine to have a small grain size. The coolant usable for the accelerative cooling includes, for example, water, air, mist, etc. On the other hand, in order to make the cold-rolled and annealed sheet steel have M/G of not smaller than 0.8, it is desirable that the grain size of the grains constituting the hot-rolled sheet steel is not larger than 50 $\mu$m.

The coiling temperature at which the sheet steel is coiled is desirably as high as possible in order to make the coiled sheet steel have large carbonitride. However, if the coiling temperature is higher than 750° C., too thick scale is formed on the surface of the sheet steel, and the working load for removing the scale shall be great. If, on the other hand, the coiling temperature is lower than 400° C., the sheet steel is difficult to coil at such a low coiling temperature. Therefore, the coiling temperature is defined to range from 750 to 400° C.

Next, the thus hot-rolled sheet steel is cold-rolled to a reduction falling between 50 and 95%.

The cold-rolling ensures good deep drawability of the resulting sheet steel. In order to make the cold-rolled sheet steel have a high r value, the cold-rolling is effected to a reduction of not smaller than 50%. If the reduction is smaller than 50%, the cold-rolled sheet steel could not have a high r value. However, if the reduction is larger than 95%, the r value of the cold-rolled sheet steel is rather lowered. Accordingly, the reduction of the cold-rolling is defined to fall between 50 and 95%.

After having been cold-rolled, the sheet steel is then annealed for recrystallization at a temperature ranging from 700 to 920° C.

If the annealing temperature is lower than 700° C., the carbide in the steel could not be dissolved sufficiently to give a desired amount of solute C, resulting in that the annealed sheet steel could not have the intended degree of BH. On the other hand, however, if the annealing temperature is higher than 920° C., $\alpha$–$\gamma$ transformation occurs in the annealed sheet steel whereby the structure of the steel is randomized, resulting in that the r value of the steel is lowered and the deep drawability thereof is lowered. Accordingly, the annealing temperature for recrystallization is defined to fall between 700 and 920° C. For good deep drawability, the annealing temperature is desirably not lower than 750° C. Any of box annealing or continuous annealing may be employed herein. However, continuous annealing is preferred in order to homogenize the sheet steel.

After having been annealed for recrystallization, the sheet steel may optionally be skinpass-rolled to a degree of not larger than 10% to thereby correct the shape of the sheet steel and to control the surface roughness thereof.

The cold-rolled sheet steel of the invention may be directly subjected to secondary working. Needless-to-say, it may be subjected to secondary working after having been additionally surface-treated. For the surface-treatment, for example, the sheet steel may be plated with zinc, zinc alloys or tin, or may be enameled.

If desired, the sheet steel of the invention may be, after having been annealed or galvanized, subjected to special treatment. For example, it may be plated with Ni to thereby improve the phosphatability, the weldability, the press formability and the corrosion resistance of the thus-plated sheet steel.

Now, the invention is described in more detail with reference to the following Examples, which, however, are not intended to restrict the scope of the invention.

EXAMPLE 1

Steel slabs each having the chemical composition shown in Table 1 below were separately hot-rolled under the condition shown in Table 2 below into hot-rolled bands having a thickness of 3.5 mm. These were cold-rolled to have a thickness of 0.8 mm. Next, the thus cold-rolled bands were annealed for recrystallization in a continuous annealing line at a temperature falling between 750 and 880° C. The resulting steel bands were then skinpass-rolled to a degree of 0.8% to obtain final products.

Those final products were tested to measure and determine the values AI, $AI_{QUENCH}$ and A, and also the tensile characteristics, the r value, the BH-ability and the room temperature-aging property of them.

To determine its tensile characteristics, each sample was cut into JIS No. 5 tension test pieces, and the yield point, the tensile strength and the elongation of each test piece were measured. To measure its r value, each test piece was pre-treated to impart 15% tensile pre-strain thereto, and tested in a three-point test method, in which the $r_L$ value in the L-direction (rolling direction), the $r_D$ value in the D-direction (this is at an angle of 45 degrees to the rolling direction), and the $r_C$ value in the C-direction (this is at an angle of 90 degrees to the rolling direction) were obtained and averaged [$r=(r_L+2\ r_D+r_C)/4$].

To measure the degree of BH of the samples, the samples were pre-treated to impart 2% tensile pre-strain thereto, and then heated at 170° C. for 20 minutes, whereupon the increase in the yield stress of the heat-treated sample, or that is, the difference in the yield stress between the heat-treated sample and the non-treated one was obtained, which indicates the degree of BH of the tested sample.

To determine their room temperature-aging property, the samples were aged at 100° C. for 10 hours, and their yield point elongation was measured. The room temperature-aging property of samples having a degree of yield point elongation of not larger than 0.2% is good.

The test data are shown in Table 2.

From Table 2, it is known that the samples of the invention (No. 1, No. 4, No. 6, No. 7) are better than the comparative samples not falling within the scope of the invention. Precisely, the former had a higher degree of BH, and the yield point elongation of the former, after having been aged at 100° C. for 10 hours, was not larger than 0.2% and was low. Thus, it is known that the samples of the invention have good BH-ability and good anti-aging property.

Comparative sample No. 2 had a low value A of smaller than 0.4, and, after having been aged, its yield point elongation was 0.60 and was high. This is because the annealing temperature for this sample was too high. Comparative sample No. 3 had a low value A of smaller than 0.4, and, after having been aged, its yield point elongation was 0.70 and was high. This is because the chemical composition of this sample is outside the scope of the invention and the annealing temperature for this was too high.

Comparative sample No. 5 had a low value of $AI_{QUENCH}$ of smaller than 30 MPa and a low degree of BH of 10 MPa, as the annealing temperature for this was too low.

Comparative sample No. 8 had a low value of $AI_{QUNECH}$ of smaller than 30 MPa and a low degree of BH of 7 MPa, as its chemical composition is outside the scope of the invention.

EXAMPLE 2

Steel slabs each having the chemical composition shown in Table 3 below were separately hot-rolled under the condition shown in Table 4 below into hot-rolled bands having a thickness of 3.5 mm. The condition for cooling these that had been hot-rolled and finished was controlled by varying the period of time after which the hot-rolled bands were cooled with water, whereby the grains constituting each band were made to have the grain size indicated. These hot-rolled bands were cold-rolled to have a thickness of 0.8 mm. Next, the thus cold-rolled bands were annealed for recrystallization in a continuous annealing line at a temperature falling between 780 and 880° C. The resulting steel bands were then skinpass-rolled to a degree of 0.8% to obtain final products.

Those final products were tested to measure and determine the mean grain size G, the mean misorientation M, the tensile characteristics, the r value, the degree of BH, and the room temperature-aging property of them.

To determine the mean grain size G, test pieces were sampled at random from three sites of each final product, and the cross section of each test piece was observed with an optical microscope to measure the grain size of each grain seen in the cross section. The data were averaged to obtain the mean value.

To determine the mean misorientation M, obtained was EBSD of each test piece, and the orientation of each grains seen in the cross section of the test piece was measured. Precisely, 50 or more grains in one test piece were measured to obtain the orientational difference (inclined angle) between the adjacent grain boundaries in each test piece. The data were averaged to obtain the mean value.

The test data are shown in Table 4.

From Table 4, it is known that the samples of the invention (No. 1, No. 4, No. 6, No. 7) are better than the comparative samples not falling within the scope of the invention. Precisely, the former had a higher degree of ductility for uniform elongation, a higher r value and a higher degree of BH. In addition, after having been aged at 100° C. for 10 hours, the yield point elongation of the former was not larger than 0.2% and was low. Thus, it is known that the samples of the invention have good BH-ability, good workability and good anti-aging property.

Comparative sample No. 2 had a low value M/G of smaller than 0.8, a low degree of ductility for uniform elongation, and a low r value, and, after having been aged, its yield point elongation was 0.60 and was high. This is because the grain size of the grains constituting the hot-rolled band of this sample was large, and the annealing temperature for this was too high. Comparative sample No. 3 had a low value M/G of smaller than 0.8, and, after having been aged, its yield point elongation was 0.70 and was high. This is because the Ti content of this sample is outside the defined range, the grain size of the grains constituting the hot-rolled band was large, and the annealing temperature was too high. Comparative sample No. 5 had a low degree of ductility for uniform elongation and a low r value, and, after having been aged, its yield point elongation was 0.75 and was high. This is because the C content of this sample was outside the defined range.

EXAMPLE 3

Steel slabs each having the chemical composition shown in Table 5 below were separately hot-rolled under the condition shown in Table 6 below into hot-rolled bands having a thickness of 3.5 mm. These hot-rolled bands were cold-rolled to a reduction of 77% or 45% as in Table 6. Next, the thus cold-rolled bands were annealed for recrystallization in a continuous annealing line, under the condition shown in Table 6. The resulting steel bands were then skinpass-rolled to a degree of 0.8% to obtain final products.

Those final products were tested to measure and determine the tensile characteristics, the r value, the degree of BH, and the AI value of them.

The test data are shown in Table 6.

In Tables 5 and 6, the samples with X={Ti/48−(N/14+S/32)}/(C/12), Z={−0.235×$T_{SR}$+305}/S, and 0.5≦X≦4.1≦Z are within the scope of the invention.

From Table 6, it is known that the samples of the invention (No. 1, No. 2, No. 4, No. 5, No. 7, No. 8, No. 9 to No. 11) have a higher degree of BH, a lower AI value, better BH-ability and better anti-aging property than the comparative samples not falling within the scope of the invention.

Comparative samples No. 3 and No. 6 had a low degree of BH of smaller than 30 MPa, as the slab reheating temperature was outside the defined range (Z<1). Comparative sample No. 8 had a low degree of BH of smaller than 30 MPa, as its slab composition (X) was outside the defined range (X>4).

Comparative sample No. 12 had a low degree of elongation and a low r value, as the finishing delivery temperature was outside the defined range.

Comparative sample No. 13 had a low r value, as the cold-rolling reduction was outside the defined range.

Comparative sample No. 14 had a low degree of elongation and a low r value, as the annealing temperature for recrystallization was outside the defined range.

EXAMPLE 4

Steel slabs each having the chemical composition shown in Table 7 below were separately hot-rolled under the condition shown in Table 8 below into hot-rolled bands having a thickness of 3.5 mm. These hot-rolled bands were cold-rolled to a reduction of 80%, into cold-rolled bands having a thickness of 0.7 mm. Next, in a continuous galvanizing line, these bands were annealed for recrystallization at a temperature falling between 730 and 930° C., then galvanized in a plating bath of 0.01% Al/Zn to have a coating weight of 50 g/$m^2$, and then heated at 550° C. Thus were obtained galvannealed steel bands. Then, these bands were skinpass-rolled to a degree of 0.8% to obtain final products. Those final products were tested to measure and determine their characteristics (tensile characteristics, r value, BH-ability, alti-aging property). The test data are shown in Table 8.

To determine the anti-aging property, each sample was aged at 100° C. for 10 hours, and its yield point elongation was measured. The samples having an yield point elongation of larger than 1% were bad (X), and those having an yield point elongation of not larger than 1% were good (O).

In Table 7, X=(Nb/93)/(C/12), and the samples with X of from 0.7 to 1.2 are within the scope of the invention.

From Table 8, it is known that the samples of the invention (No. 1, No. 3, No. 4, No. 5, No. 8, No. 9) are better than the comparative samples not falling within the scope of the invention. Precisely, the former had a higher r value of larger than 1.2, a higher degree of BH of not smaller than 30 MPa, and a lower degree of yield point elongation of not larger than 1.0%. Thus, it is known that the samples of the invention have good deep drawability, good BH-ability and good anti-aging property.

Comparative sample No. 2 had a low r value of 1.2 and a low degree of BH of smaller than 30 MPa, as the annealing temperature for this sample was outside the defined range (that is, lower than 750° C.).

Comparative sample No. 6 had a low r value of 1.1, and, after having been aged, had a high degree of yield point elongation of 1.2, as the annealing temperature for this sample was outside the defined range (that is, higher than 920° C.).

Comparative sample No. 7 had a low r value of 1.2, as the finishing delivery temperature for this sample was outside the defined range (that is, higher than 960° C.).

Comparative sample No. 10 had a low r value of 1.2, and, after having been aged, had a high degree of yield point elongation of 1.1, as the coiling temperature for this sample was outside the defined range (that is, lower than 400° C.).

Comparative sample No. 11 had a low r value of 1.2, and, after having been aged, had a high degree of yield point elongation of 1.45, as the slab composition of this sample was outside the scope of the invention.

Comparative sample No. 12 had a low degree of BH of smaller than 30 MPa, as the slab composition of this sample was outside the scope of the invention.

Comparative sample No. 13 had a low r value of 1.3, and, after having been aged, had a high degree of yield point elongation of 1.35, as the slab composition of this sample was outside the scope of the invention.

TABLE 1

| | Chemical Composition (wt. %) | | | | | | | | | | |
|---|---|---|---|---|---|---|---|---|---|---|---|
| Sample No. | C | Si | Mn | P | S | Al | N | Ti | Nb | B | Remarks |
| A | 0.0025 | 0.01 | 0.12 | 0.008 | 0.0005 | 0.032 | 0.0019 | 0.028 | — | 0.0015 | Sample of the Invention |
| B | 0.0022 | 0.01 | 0.11 | 0.009 | 0.0080 | 0.033 | 0.0020 | — | 0.0015 | — | Comparative Sample |
| C | 0.0023 | 0.03 | 0.52 | 0.035 | 0.0025 | 0.032 | 0.0019 | 0.029 | 0.002 | 0.0013 | Sample of the Invention |
| D | 0.0024 | 0.03 | 0.22 | 0.011 | 0.0025 | 0.032 | 0.0019 | 0.029 | 0.002 | — | Sample of the Invention |
| E | 0.0023 | 0.01 | 0.22 | 0.011 | 0.0025 | 0.032 | 0.0019 | 0.029 | — | — | Sample of the Invention |
| F | 0.0045 | 0.01 | 0.12 | 0.010 | 0.0090 | 0.029 | 0.0035 | 0.03 | — | — | Comparative Sample |

TABLE 2

| | | Hot-rolling Condition | | | | | | |
|---|---|---|---|---|---|---|---|---|
| No. | Sample No. | Slab Reheating Temp. (° C.) | Finishing Delivery Temp. (° C.) | Coiling Temp. (° C.) | Annealing Temp. (° C.) | Al (MPa) | $Al_{O^*}$ (MPa) | A value |
| 1 | A | 950 | 880 | 600 | 860 | 12 | 48 | 0.75 |
| 2 | | 1250 | 880 | 600 | 880 | 34 | 40 | 0.28 |
| 3 | B | 1250 | 880 | 600 | 880 | 35 | 42 | 0.17 |

TABLE 2-continued

| | | | | | | | | |
|---|---|---|---|---|---|---|---|---|
| 4 | C | 1050 | 880 | 600 | 830 | 13 | 49 | 0.73 |
| 5 | | 1250 | 880 | 600 | 750 | 5 | 10 | 0.20 |
| 6 | D | 950 | 880 | 600 | 830 | 15 | 45 | 0.67 |
| 7 | E | 1050 | 880 | 600 | 830 | 15 | 45 | 0.67 |
| 8 | F | 1050 | 880 | 600 | 830 | 2 | 5 | 0.60 |

| | Tensile Characteristics | | | | Degree of | Yield Point | |
|---|---|---|---|---|---|---|---|
| No. | YS (MPa) | TS (MPa) | EI (%) | r value | BH (MPa) | Elongation** (%) | Remarks |
| 1 | 150 | 290 | 55 | 2.3 | 53 | 0.05 | Sample of the Invention |
| 2 | 140 | 280 | 56 | 2.1 | 42 | 0.6 | Comparative Sample |
| 3 | 150 | 290 | 53 | 2.2 | 43 | 0.7 | Comparative Sample |
| 4 | 180 | 345 | 46 | 2.0 | 52 | 0.05 | Sample of the Invention |
| 5 | 190 | 355 | 42 | 1.6 | 10 | 0.05 | Comparative Sample |
| 6 | 150 | 290 | 54 | 2.2 | 52 | 0.05 | Sample of the Invention |
| 7 | 140 | 280 | 56 | 2.1 | 55 | 0.05 | Sample of the Invention |
| 8 | 190 | 295 | 46 | 1.6 | 7 | 0.05 | Comparative Sample |

*$Al_Q$: $Al_{QUENCH}$
**Yield Point Elongation: after aged at 100° C. for 10 hours.

TABLE 3

| | Chemical Composition (wt. %) | | | | | | | | | | |
|---|---|---|---|---|---|---|---|---|---|---|---|
| Sample No. | C | Si | Mn | P | S | Al | N | Ti | Nb | B | Remarks |
| A | 0.0023 | 0.01 | 0.11 | 0.009 | 0.0008 | 0.032 | 0.0019 | 0.028 | — | 0.0015 | Sample of the Invention |
| B | 0.0021 | 0.01 | 0.13 | 0.011 | 0.0070 | 0.034 | 0.0020 | — | 0.015 | — | Comparative Sample |
| C | 0.0025 | 0.03 | 0.53 | 0.034 | 0.0028 | 0.032 | 0.0018 | 0.028 | 0.002 | 0.0010 | Sample of the Invention |
| D | 0.0023 | 0.03 | 0.18 | 0.012 | 0.0025 | 0.035 | 0.0019 | 0.030 | 0.002 | — | Sample of the Invention |
| E | 0.0024 | 0.01 | 0.12 | 0.010 | 0.0026 | 0.032 | 0.0018 | 0.028 | — | — | Sample of the Invention |
| F | 0.0060 | 0.01 | 0.11 | 0.010 | 0.0080 | 0.033 | 0.0022 | 0.04 | 0.005 | — | Comparative Sample |

TABLE 4

| | | Hot-rolling Condition | | | | Grain | | | |
|---|---|---|---|---|---|---|---|---|---|
| | | Slab Reheating | Finishing Delivery | Coiling | Time before | Size of Hot-rolled | Annealing | Tensile Characteristics | |
| No. | Sample No. | Temp. (° C.) | Temp. (° C.) | Temp. (° C.) | Cold-rolling (sec) | Band (μm) | Temp. (° C.) | YS (MPa) | TS (MPa) |
| 1 | A | 950 | 880 | 600 | 0.7 | 35 | 780 | 150 | 290 |
| 2 | | 1250 | 920 | 600 | 2.0 | 70 | 890 | 140 | 280 |
| 3 | B | 1250 | 910 | 600 | 2.0 | 65 | 890 | 150 | 290 |
| 4 | C | 1050 | 880 | 600 | 0.8 | 38 | 820 | 180 | 345 |
| 5 | F | 1250 | 910 | 600 | 2.2 | 75 | 850 | 180 | 340 |
| 6 | D | 950 | 880 | 600 | 0.8 | 33 | 830 | 150 | 290 |
| 7 | E | 1050 | 880 | 600 | 0.7 | 38 | 800 | 140 | 280 |

| | Tensile Characteristics | | | | | | |
|---|---|---|---|---|---|---|---|
| No. | EI (%) | Degree of Uniform Elongation (%) | r value | Degree of BH (MPa) | M/G* | Yield Point Elongation** (%) | Remarks |
| 1 | 54 | 36 | 2.2 | 53 | 2.22 | 0.05 | Sample of the Invention |
| 2 | 56 | 32 | 1.8 | 42 | 0.78 | 0.60 | Comparative Sample |
| 3 | 53 | 31 | 1.9 | 43 | 0.75 | 0.70 | Comparative Sample |
| 4 | 46 | 33 | 2.1 | 52 | 0.98 | 0.05 | Sample of the Invention |
| 5 | 40 | 25 | 1.2 | 42 | 0.85 | 0.75 | Comparative Sample |
| 6 | 54 | 36 | 2.2 | 50 | 0.92 | 0.05 | Sample of the Invention |
| 7 | 55 | 35 | 2.1 | 52 | 0.88 | 0.05 | Sample of the Invention |

*M = Mean Misorientation (degree), G = Mean Grain Size (μm)
**Yield Point Elongation: after aged at 100° C. for 10 hours.

TABLE 5

| Sample No. | Chemical Composition (wt. %) C | Si | Mn | P | S | Al | N | Ti | Nb | B | X* | Remarks |
|---|---|---|---|---|---|---|---|---|---|---|---|---|
| A | 0.0025 | 0.01 | 0.12 | 0.008 | 0.0025 | 0.022 | 0.0019 | 0.025 | — | 0.015 | 1.47 | Sample of the Invention |
| B | 0.0022 | 0.01 | 0.11 | 0.011 | 0.0040 | 0.028 | 0.0018 | 0.028 | — | — | 1.80 | Sample of the Invention |
| C | 0.0021 | 0.01 | 0.11 | 0.009 | 0.0075 | 0.030 | 0.0020 | 0.031 | 0.002 | 0.0003 | 1.53 | Sample of the Invention |
| D | 0.0023 | 0.03 | 0.52 | 0.045 | 0.0035 | 0.032 | 0.0019 | 0.029 | — | 0.0016 | 1.87 | Sample of the Invention |
| E | 0.0022 | 0.01 | 0.12 | 0.011 | 0.0045 | 0.025 | 0.0018 | 0.052 | — | 0.0011 | 4.44 | Comparative Sample |
| F | 0.0022 | 0.01 | 0.12 | 0.011 | 0.0025 | 0.025 | 0.0018 | 0.032 | 0.002 | — | 2.50 | Sample of the Invention |
| G | 0.0023 | 0.01 | 0.12 | 0.011 | 0.0007 | 0.025 | 0.0018 | 0.023 | — | 0.0012 | 1.72 | Sample of the Invention |

TABLE 6

| No. | Sample No. | Slab Reheating Temp. (° C.) | Finishing Delivery Temp. (° C.) | Coiling Temp. (° C.) | Z* | Cold-rolling Reduction (%) | Annealing Temp. (° C.) |
|---|---|---|---|---|---|---|---|
| 1 | A | 1000 | 880 | 600 | 2.80 | 77 | 830 |
| 2 | | 970 | 800 | 620 | 3.08 | | |
| 3 | | 1250 | 890 | 600 | 0.45 | | |
| 4 | B | 1050 | 880 | 600 | 1.46 | | |
| 5 | C | 970 | 890 | 700 | 1.03 | | |
| 6 | | 1250 | 890 | 600 | 0.15 | | |
| 7 | D | 1050 | 880 | 600 | 1.66 | | |
| 8 | E | 1050 | 890 | 600 | 1.29 | | |
| 9 | F | 1050 | 880 | 600 | 2.33 | | |
| 10 | G | 1220 | 890 | 600 | 2.61 | | |
| 11 | | 930 | 880 | 600 | 7.00 | | |
| 12 | A | 1150 | 990 | 600 | 1.39 | 77 | 830 |
| 13 | | 1150 | 890 | 600 | 1.39 | 45 | 830 |
| 14 | | 1150 | 890 | 600 | 1.39 | 77 | 680 |

| No. | YS (MPa) | TS (MPa) | EI (%) | r value | Degree of BH (MPa) | Al (MPa) | Remarks |
|---|---|---|---|---|---|---|---|
| 1 | 150 | 290 | 55 | 2.3 | 62 | 12 | Sample of the Invention |
| 2 | 130 | 285 | 56 | 2.2 | 58 | 10 | Sample of the Invention |
| 3 | 150 | 290 | 53 | 1.9 | 10 | 5 | Comparative Sample |
| 4 | 150 | 285 | 55 | 2.2 | 61 | 13 | Sample of the Invention |
| 5 | 155 | 290 | 56 | 2.3 | 55 | 12 | Sample of the Invention |
| 6 | 155 | 290 | 53 | 1.9 | 10 | 5 | Comparative Sample |
| 7 | 180 | 345 | 46 | 2.1 | 59 | 15 | Sample of the Invention |
| 8 | 150 | 285 | 55 | 2.0 | 5 | 0 | Comparative Sample |
| 9 | 150 | 290 | 55 | 2.3 | 59 | 15 | Sample of the Invention |
| 10 | 155 | 285 | 53 | 2.0 | 35 | 11 | Sample of the Invention |
| 11 | 140 | 275 | 55 | 2.1 | 38 | 10 | Sample of the Invention |
| 12 | 130 | 280 | 49 | 1.4 | 35 | 12 | Comparative Sample |
| 13 | 150 | 290 | 54 | 1.3 | 35 | 10 | Comparative Sample |
| 14 | 290 | 340 | 22 | 1.0 | 5 | 0 | Comparative Sample |

TABLE 7

| Sample No. | Chemical Composition (wt. %) C | Si | Mn | P | S | Al | N | Nb | B | Ti | X* | Remarks |
|---|---|---|---|---|---|---|---|---|---|---|---|---|
| A | 0.0091 | 0.01 | 0.21 | 0.008 | 0.006 | 0.042 | 0.0019 | 0.064 | — | — | 0.91 | Sample of the Invention |
| B | 0.0102 | 0.01 | 0.11 | 0.011 | 0.005 | 0.038 | 0.0018 | 0.068 | 0.0007 | — | 0.86 | Sample of the Invention |
| C | 0.0075 | 0.01 | 0.41 | 0.009 | 0.008 | 0.030 | 0.0020 | 0.053 | — | 0.012 | 0.91 | Sample of the Invention |
| D | 0.0115 | 0.01 | 1.05 | 0.025 | 0.006 | 0.032 | 0.0019 | 0.082 | 0.0013 | — | 0.92 | Sample of the Invention |
| E | 0.0025 | 0.01 | 0.45 | 0.065 | 0.005 | 0.035 | 0.0018 | 0.017 | 0.0011 | — | 0.88 | Comparative Sample |
| F | 0.0098 | 0.01 | 0.12 | 0.011 | 0.003 | 0.025 | 0.0018 | 0.105 | — | — | 1.38 | Comparative Sample |
| G | 0.0088 | 0.01 | 0.22 | 0.011 | 0.006 | 0.038 | 0.0022 | 0.042 | — | — | 0.62 | Comparative Sample |

*: X = (Nb/93)/(C/12)

TABLE 8

| No. | Sample No. | Hot-rolling Condition: Slab Reheating Temp. (° C.) | Hot-rolling Condition: Finishing Delivery Temp. (° C.) | Hot-rolling Condition: Coiling Temp. (° C.) | Cold-rolling Reduction (%) | Annealing Temp. for Recrystallization (° C.) | Product Quality: Tensile Characteristics: Yield Stress (MPa) | Tensile Strength (MPa) | Elongation (%) |
|---|---|---|---|---|---|---|---|---|---|
| 1 | A | 1200 | 900 | 680 | 80 | 850 | 225 | 345 | 44 |
| 2 | | 1200 | 900 | 600 | 80 | 730 | 290 | 375 | 22 |
| 3 | B | 1200 | 900 | 600 | 80 | 830 | 235 | 360 | 41 |
| 4 | | 1050 | 900 | 680 | 80 | 850 | 228 | 350 | 43 |
| 5 | C | 1050 | 900 | 680 | 80 | 850 | 220 | 340 | 45 |
| 6 | | 1120 | 900 | 600 | 80 | 930 | 350 | 420 | 20 |
| 7 | | 1120 | 980 | 600 | 80 | 830 | 250 | 330 | 30 |
| 8 | D | 1120 | 900 | 600 | 80 | 830 | 280 | 430 | 34 |
| 9 | | 1050 | 900 | 680 | 80 | 850 | 265 | 410 | 36 |
| 10 | | 1120 | 900 | 320 | 80 | 830 | 290 | 440 | 32 |
| 11 | E | 1120 | 900 | 600 | 80 | 850 | 320 | 420 | 28 |
| 12 | F | 1120 | 900 | 600 | 80 | 850 | 223 | 342 | 44 |
| 13 | G | 1120 | 900 | 600 | 80 | 850 | 255 | 345 | 41 |

| No. | Product Quality: Workability r value | BH-ability: Degree of BH (MPa) | Anti-aging Property: Yield Point Elongation** (%) | Evaluation | Remarks |
|---|---|---|---|---|---|
| 1 | 2.0 | 65 | 0.05 | ○ | Sample of the Invention |
| 2 | 1.2 | 20 | 0.05 | ○ | Comparative Sample |
| 3 | 1.9 | 55 | 0.05 | ○ | Sample of the Invention |
| 4 | 2.0 | 68 | 0.05 | ○ | Sample of the Invention |
| 5 | 2.0 | 63 | 0.05 | ○ | Sample of the Invention |
| 6 | 1.1 | 60 | 1.2 | X | Comparative Sample |
| 7 | 1.2 | 55 | 0.5 | ○ | Comparative Sample |
| 8 | 1.7 | 58 | 0.05 | ○ | Sample of the Invention |
| 9 | 1.8 | 65 | 0.05 | ○ | Sample of the Invention |
| 10 | 1.2 | 85 | 1.1 | X | Comparative Sample |
| 11 | 1.2 | 59 | 1.45 | X | Comparative Sample |
| 12 | 1.9 | 5 | 0.05 | ○ | Comparative Sample |
| 13 | 1.3 | 68 | 1.35 | X | Comparative Sample |

As has been mentioned in detail hereinabove, the present invention has the industrial advantage of stably producing bake-hardenable sheet steel with good anti-aging property which is superior to any other conventional, bake-hardenable sheet steel.

Since conventional, bake-hardenable sheet steel has poor anti-aging property, its use in car industry is often problematic in that the sheet steel has many stretcher strains when worked by pressing. Because of its problem, conventional bake-hardenable sheet steel must be stored for a long period of time before it is worked. In addition, another problem of conventional bake-hardenable sheet steel is that it is often aged during shipping. Because of its problem, conventional bake-hardenable sheet steel could not be exported. For these reasons, foreign car manufacturers could not use bake-hardenable sheet steel, even though they desire to use it.

The present invention solves all the problems as above. Therefore, domestic car manufacturers do not need to store the bake-hardenable sheet steel of the invention for a long period of time before they use it; and, in addition, the bake-hardenable sheet steel of the invention can be exported to foreign car manufacturers. Thus, the industrial advantages of the invention are great.

While the invention has been described in detail and with reference to specific embodiments thereof, it will be apparent to one skilled in the art that various changes and modifications can be made therein without departing from the spirit and scope thereof.

What is claimed is:

1. Bake-hardenable sheet steel with good anti-aging property, which has a chemical composition comprising, in terms of % by weight, not larger than 0.005% of C, not larger than 1.0% of Si, not larger than 3.0% of Mn, not larger than 0.15% of P, not larger than 0.05% of S, from 0.01 to 0.20% of Al, not larger than 0.01% of N, and from 0.01 to 0.2% of Ti, with a balance of Fe and inevitable impurities, and has a degree of bake hardenability (BH) of not smaller than 30 MPa, and which is characterized in that the value A defined below is not smaller than 0.4 and that the value $AI_{QUENCH}$ defined below is not smaller than 30 MPa:

$$A=(AI_{QUENCH}-AI)/AI_{QUENCH}$$

wherein;

$AI_{QUENCH}$ indicates the aging index (MPa) of the sheet steel having been heated at 500° C. for 40 seconds and then quenched in water, AI indicates the aging index (MPa) of the sheet steel, and the "aging index" indicates the increase in the yield stress (MPa) of the sheet steel, which is pre-treated to have a tensile pre-strain of 7.5% and then heated at 100° C. for 30 minutes, and this is the difference between the yield stress of the heat-treated sheet steel and that of the non-treated one.

2. Bake-hardenable sheet steel with good anti-aging property as claimed in claim 1, which further contains at least one of from 0.001 to 0.2% of Nb and from 0.0001 to 0.0080% of B.

3. Bake-hardenable sheet steel with good anti-aging property, which has a chemical composition comprising, in terms of % by weight, not larger than 0.005% of C, not larger than 1.0% of Si, not larger than 3.0% of Mn, not larger than 0.15% of P, not larger than 0.05% of S, from 0.01 to 0.20% of Al, not larger than 0.01% of N, and from 0.01 to 0.2% of Ti, with a balance of Fe and inevitable impurities, and has a degree of bake hardenability (BH) of not smaller than 30 MPa, and which is characterized in that the ratio of the mean misorientation, M (degree), to the mean grain size, G ($\mu$m), M/G, is not smaller than 0.8.

4. Bake-hardenable sheet steel with good anti-aging property as claimed in claim 3, which further contains at least one of from 0.001 to 0.2% of Nb and from 0.0001 to 0.0080% of B.

5. A method for producing bake-hardenable sheet steel with good anti-aging property of any one of claims 1 to 4, which comprises hot-rolling a steel slab having a chemical composition that comprises, in terms of % by weight, not larger than 0.005% of C, not larger than 1.0% of Si, not larger than 3.0% of Mn, not larger than 0.15% of P, not larger than 0.05% of S, from 0.01 to 0.20% of Al, not larger than 0.01% of N, and from 0.01 to 0.2% of Ti, with a balance of Fe and inevitable impurities, into hot-rolled sheet steel, while finishing the hot-rolling at a finishing delivery temperature ranging from 960 to 650° C., immediately cooling the resulting hot-rolled sheet steel after completion of hot-rolling and coiling the resulting sheet steel at a coiling temperature ranging from 750 to 400° C., then cold-rolling the sheet steel to a reduction falling between 50 and 95%, and thereafter annealing it for recrystallization at a temperature falling between 700 and 920° C.

6. The method for producing bake-hardenable sheet steel, with good anti-aging property as claimed in claim 5, wherein the slab further contains at least one of from 0.001 to 0.2% of Nb and from 0.0001 to 0.0080% of B.

7. A method for producing bake-hardenable sheet steel with good anti-aging property, which comprises heating a steel slab having a chemical composition that comprises, in terms of % by weight, from 0.0007 to 0.0050% of C, not larger than 0.5% of Si, not larger than 2.0% of Mn, not larger than 0.10% of P, not larger than 0.008% of S, from 0.01 to 0.20% of Al, not larger than 0.01% of N, and from 0.005 to 0.08% of Ti, with a balance of Fe and inevitable impurities, and with the amounts of C, Ti, N and S satisfying the following condition (1), at a temperature ($T_{SR}$) that satisfies the following condition (2), then hot-rolling it into sheet steel, while finishing the hot-rolling at a finishing delivery temperature ranging from 960 to 650° C., immediately cooling the resulting hot-rolled sheet steel after completion of hot-rolling and coiling the resulting sheet steel at a coiling temperature ranging from 750 to 400° C., then cold-rolling the sheet steel to a reduction falling between 50 and 95%, and thereafter annealing it for recrystallization at a temperature falling between 700 and 920° C.:

$$0.5\times(C/12)\leqq Ti/48-(N/14+S/32)\leqq 4\times(C/12) \quad (1)$$

wherein C, Ti, N and S are in terms of % by weight, $$S\leqq -0.235\times T_{SR}+305 \quad (2)$$

wherein;

S indicates the sulfur content of the slab (ppm), and $T_{SR}$ indicates the slab reheating temperature (° C.).

8. The method for producing bake-hardenable sheet steel with good anti-aging property as claimed in claim 7, wherein the slab further contains at least one of from 0.001 to 0.015% of Nb and from 0.0001 to 0.0050% of B.

9. Bake-hardenable sheet steel with good anti-aging property, which is characterized in that it has a chemical composition comprising, in terms of % by weight, from 0.005 to 0.02% of C, not larger than 0.5% of Si, not larger than 3.0% of Mn, not larger than 0.05% of P, not larger than 0.02% of S, from 0.01 to 0.20% of Al, not larger than 0.01% of N, and from 0.025 to 0.19% of Nb, with a balance of Fe and inevitable impurities, and with the amounts of C and Nb satisfying the condition defined below, and that it has a degree of bake hardenability (BH) of not smaller than 30 MPa:

$$0.7\times(C/12)\leqq Nb/93\leqq 1.2\times(C/12)$$

wherein;

C indicates the C content (% by weight), and

Nb indicates the Nb content (% by weight).

10. Bake-hardenable sheet steel with good anti-aging property as claimed in claim 9, which further contains at least. one of from 0.0001 to 0.005% of B and from 0.001 to 0.05% of Ti.

11. A method for producing bake-hardenable sheet steel with good anti-aging property, which comprises heating a steel slab having a chemical composition that comprises, in terms of % by weight, from 0.005 to 0.02% of C, not larger than 0.5% of Si, not larger than 3.0% of Mn, not larger than 0.05% of P, not larger than 0.02% of S, from 0.01 to 0.20% of Al, not larger than 0.01% of N, and from 0.025 to 0.19% of Nb, with a balance of Fe and inevitable impurities, and with the amounts of C and Nb satisfying the condition defined below, then hot-rolling it into sheet steel, while finishing the hot-rolling at a finishing delivery temperature ranging from 960 to 650° C., immediately cooling the resulting hot-rolled sheet steel after completion of hot-rolling and then coiling the hot-rolled sheet steel at a coiling temperature ranging from 750 to 400° C., then cold-rolling it to a reduction falling between 50 and 95%, and thereafter annealing it for recrystallization at a temperature falling between 750 and 920° C.:

$$0.7\times(C/12)\leqq Nb/93\leqq 1.2\times(C/12)$$

wherein;

C indicates the C content (% by weight), and Nb indicates the Nb content (% by weight).

12. The method for producing bake-hardenable sheet steel with good anti-aging property as claimed in claim 11, wherein the slab further contains at least one of from 0.0001 to 0.005% of B and from 0.001 to 0.05% of Ti.

* * * * *